US006202350B1

(12) United States Patent
Montgomery et al.

(10) Patent No.: US 6,202,350 B1
(45) Date of Patent: Mar. 20, 2001

(54) POWER LIFTGATE DEVICE

(75) Inventors: Kyle Montgomery, Clawson; Timothy Dering, Rochester Hills; Michael Dettling, Clarkston; William R. Addison, Clinton Township, all of MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/335,065

(22) Filed: Jun. 17, 1999

(51) Int. Cl.[7] ..... E05F 15/00
(52) U.S. Cl. ..... 49/139; 49/341
(58) Field of Search ..... 49/339, 340, 341, 49/342, 139, 140; 74/625, 89.18; 296/146.8, 56

(56) References Cited

U.S. PATENT DOCUMENTS

| | | | |
|---|---|---|---|
| 3,713,472 | 1/1973 | Dozois . | |
| 3,716,945 | 2/1973 | Cooper et al. . | |
| 4,903,435 | 2/1990 | Bittmann et al. . | |
| 5,448,856 | 9/1995 | Moore et al. . | |
| 5,449,212 | 9/1995 | Seifert . | |
| 5,477,642 | 12/1995 | Legendre . | |
| 5,507,120 | 4/1996 | Current . | |
| 5,513,467 | 5/1996 | Current et al. . | |
| 5,531,498 | 7/1996 | Kowall . | |
| 5,588,258 | 12/1996 | Wright et al. . | |
| 5,851,050 | 12/1998 | Squire et al. . | |
| 6,055,776 * | 5/2000 | Dettling et al. | 49/341 |

* cited by examiner

*Primary Examiner*—Jerry Redman
(74) *Attorney, Agent, or Firm*—Mark P. Calcaterra

(57) ABSTRACT

A power liftgate device for a liftgate of a vehicle having a power drive unit and a pneumatic actuator. The pneumatic actuator is pivotally coupled between the liftgate and the vehicle and exerts a force opposing retraction of the liftgate. A driven gear is fixed to the pneumatic actuator to pivot therewith and is selectively driven by the power drive unit. The liftgate assembly further includes an engaging device that is coupled to the vehicle for engaging the power drive unit with the driven gear, thereby enabling the power drive unit to drive the driven gear. Specifically, the engaging device is positionable between an engaged and a disengaged position, wherein the engaging device is operable in the engaged position to engage the power drive unit into driving connection with the driven gear. The engaging device is also operable in the disengaged position to disengage the power drive unit from the driven gear to enable the actuator to actuate freely.

12 Claims, 1 Drawing Sheet

POWER LIFTGATE DEVICE

CROSS-REFERENCE TO RELATED APPLICATIONS

The present application is related to the following co-pending U.S. Patent Applications, which are incorporated herein by reference:

U.S. Ser. No. 09/335,350, for an, now U.S. Pat. No. 6,055,776 invention entitled "POWER LIFTGATE ARM ASSIST ASSEMBLY" [99-801]; and U.S. Serial No. 09/335,085, for, now U.S. Pat. No. 6,055,775 an invention entitled "LIFTGATE SELF CLOSING DEVICE" [99-803].

FIELD OF THE INVENTION

The present invention relates to a liftgate of a vehicle and, more particularly, to a powered liftgate assembly capable of remotely opening and closing the liftgate of the vehicle.

BACKGROUND OF THE INVENTION

Recently, sport-utility vehicles and minivans have become increasingly popular among automobile consumers. Such vehicles include large cargo areas that provide increased hauling capability relative to conventional passenger vehicles. To maximize the accessibility to these cargo areas, many vehicles are equipped with a liftgate or cargo door located at the rear of the vehicle. Typically, these liftgates are pivotally attached by hinges to the top of the cargo opening. The cargo opening is defined by the roof and rear pillars of the vehicle. To gain access to the cargo area, these liftgates commonly pivot upwardly and outwardly from the cargo opening.

In conventional liftgates, pneumatic "actuators" or "cylinders" containing compressed gas are provided on each side of the liftgate. Each pneumatic actuator is attached at one end to the liftgate and at another end to the corresponding pillar of the vehicle. When the liftgate is closed and latched, the pneumatic actuators are contracted and the gas within the actuators is compressed. When the liftgate is unlatched, the stored energy provided by the compressed gas in the pneumatic actuators forces the liftgate to open partially, thereby releasing the liftgate from the lock. The liftgate must then be manually lifted while the pneumatic actuators continue to exert an outward force on the liftgate that assists the manual opening of the liftgate. Eventually, the liftgate is manually lifted to a position where the geometric relationship of the pneumatic actuators relative to the liftgate is such that the moment arms of the pneumatic actuators are sufficiently large to enable the actuators to take over lifting the liftgate and retain the liftgate in a fully opening position. More particularly, the pivoting dynamics of the liftgate are a function of:

1) the force exerted by the pneumatic actuators ($F_a$);
2) the distance between the vector force of the pneumatic actuators and the liftgate pivot axis (d);
3) the weight of the liftgate ($F_g$); and
4) the distance of the liftgate center of gravity and the liftgate pivot axis (D).

The product of $F_a$ and d equals the moment force of the actuators. The product of $F_g$ and D equals the moment force of gravity acting on the liftgate. It should be appreciated that the force due to gravity and the force exerted by the actuators vary relative to the position of the liftgate.

It should be appreciated to one skilled in the art that the above conventional design includes an "overcenter condition." This condition provides a "center" position in which the moment exerted by the actuators is equal to the moment exerted by the weight of the liftgate. At a position above the "center" position, the upward moment forces the liftgate open. At a position below the "center" position, the downward moment overcomes the upward moment, thereby allowing the liftgate to generally close. It should be appreciated that due to the weight of conventional liftgates, opening the liftgate prior to the "center" position may be awkward and difficult. Similarly, due to the force exerted by the actuators, closing the liftgate prior to the "center" position may further be awkward and difficult.

Attempts have been made to provide hydraulic and/or cable driven systems to automatically open or close the liftgate of a vehicle. However, various disadvantages are associated with these types of systems. For example, but not limited to, the hydraulic type system requires expensive and cumbersome hydraulic pumps and actuators. Furthermore, these pumps and actuators are typically difficult to install due to their size and complexity and are generally located at a distance away from the liftgate mechanism. Likewise, cable type systems may be unreliable due to the exposure of the cable and pulleys to environmental contamination and the like.

Accordingly, there exists a need in the relevant art to provide a powered liftgate assembly that is capable of remotely opening and closing the liftgate of a vehicle. Furthermore, there exists a need in the relevant art to provide a powered liftgate assembly that is capable of being manually overridden by an operator. Moreover, there exists a need in the relevant art to provide a powered liftgate assembly that overcomes the disadvantages of the prior art.

SUMMARY OF THE INVENTION

In accordance with the broad teachings of this invention, a power liftgate device for a liftgate of a vehicle having an advantageous construction is provided. The liftgate assembly includes a power drive unit and a pneumatic actuator. The pneumatic actuator is pivotally coupled between the liftgate and the vehicle and exerts a force opposing retraction of the liftgate. A driven gear is fixed to the pneumatic actuator to pivot therewith and is selectively driven by the power drive unit. The liftgate assembly further includes an engaging device that is coupled to the vehicle for engaging the power drive unit with the driven gear, thereby enabling the power drive unit to drive the driven gear. Specifically, the engaging device is positionable between an engaged and a disengaged position, wherein the engaging device is operable in the engaged position to engage the power drive unit into driving connection with the driven gear. The engaging device is also operable in the disengaged position to disengage the power drive unit from the driven gear to enable the actuator to actuate freely.

Further areas of applicability of the present invention will become apparent from the detailed description provided hereinafter. It should be understood that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment is merely exemplary in nature and is in no way intended to limit the invention, its application, or uses. For example, the power liftgate device disclosed herein may have utility in a variety of vehicles, such as sedans and hatchbacks.

Figure 1:
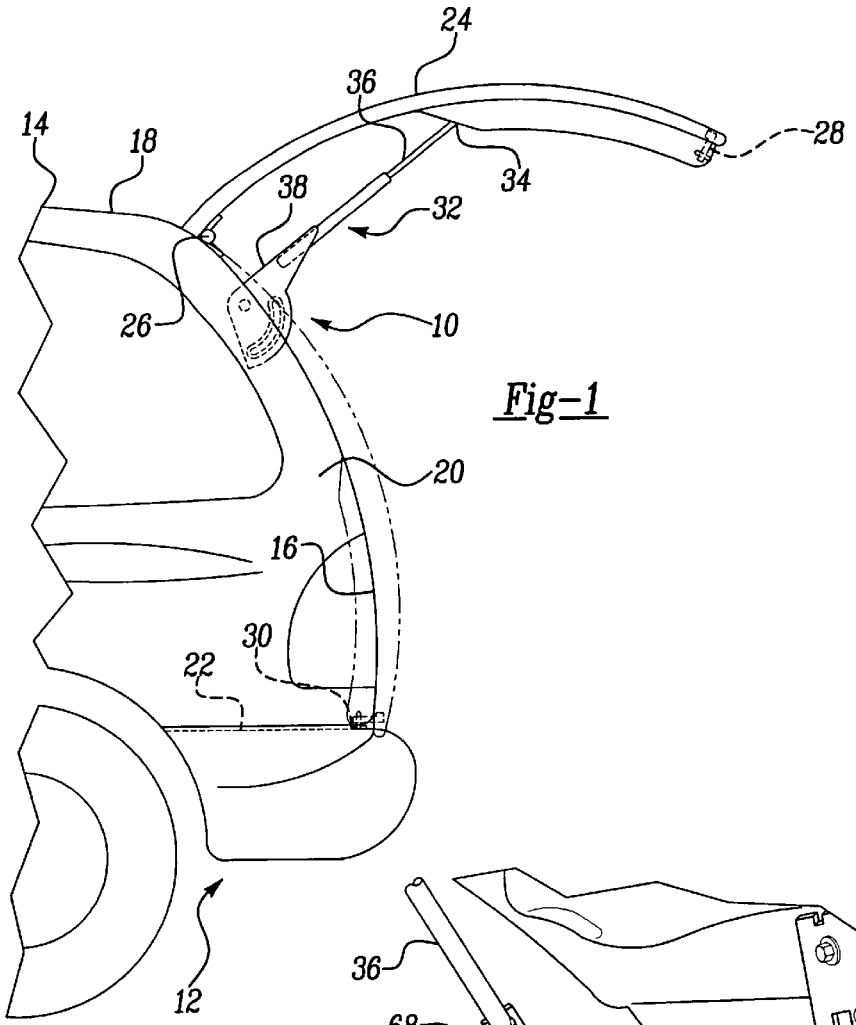
FIG. 1 is a side view of a motor vehicle employing a power liftgate device according to the teachings of the present invention.

Referring to the drawings, a power liftgate device 10 is provided in accordance with the teaching of the present invention. Power liftgate device 10 is disposed within a vehicle 12, such as a sport-utility vehicle or minivan. Vehicle 12 includes a main body 14 having a cargo-opening frame 16. Cargo opening frame 16 is generally defined by a roof 18, a pair of D-pillars 20, and a floor surface 22. Vehicle 12 further includes a liftgate or cargo door 24 pivotally mounted to cargo opening frame 16 by a pair of laterally spaced hinges 26 (only one shown). Liftgate 24 includes a latch mechanism 28 adapted to cooperate with a striker 30 opposingly mounted to vehicle 12. Latch mechanism 28 selectively retains liftgate 24 in a closed and locked position (shown in phantom in FIG. 1).

A pair of pneumatic actuator or cylinder assemblies 32 is pivotally coupled at one end to an upper inner portion 34 of liftgate 24 and at another end to the corresponding D-pillar 20 of vehicle 12. Each pneumatic actuator assembly 32 includes a strut 36 and a plate portion 38 that will be described in detail below. The pair of pneumatic actuator assemblies 32 normally biases liftgate 24 in an outward direction. That is, the pair of pneumatic actuator assemblies 32 normally opposes retraction of liftgate 24. Pneumatic actuator assemblies 32 produce an "overcenter condition" in liftgate 24 to aid in the opening of liftgate 24.

Power liftgate device 10 is preferably disposed within or adjacent to opposing D-pillars 20 of vehicle 12. It is anticipated that a single power liftgate device, having an increased motor capacity, may be disposed in a single D-pillar. Alternatively, a pair of power liftgate devices may each be disposed in opposing D-pillars. This double configuration enables smaller motors to be used. In the interest of brevity, only one power liftgate device will be described in detail.

Figure 2:
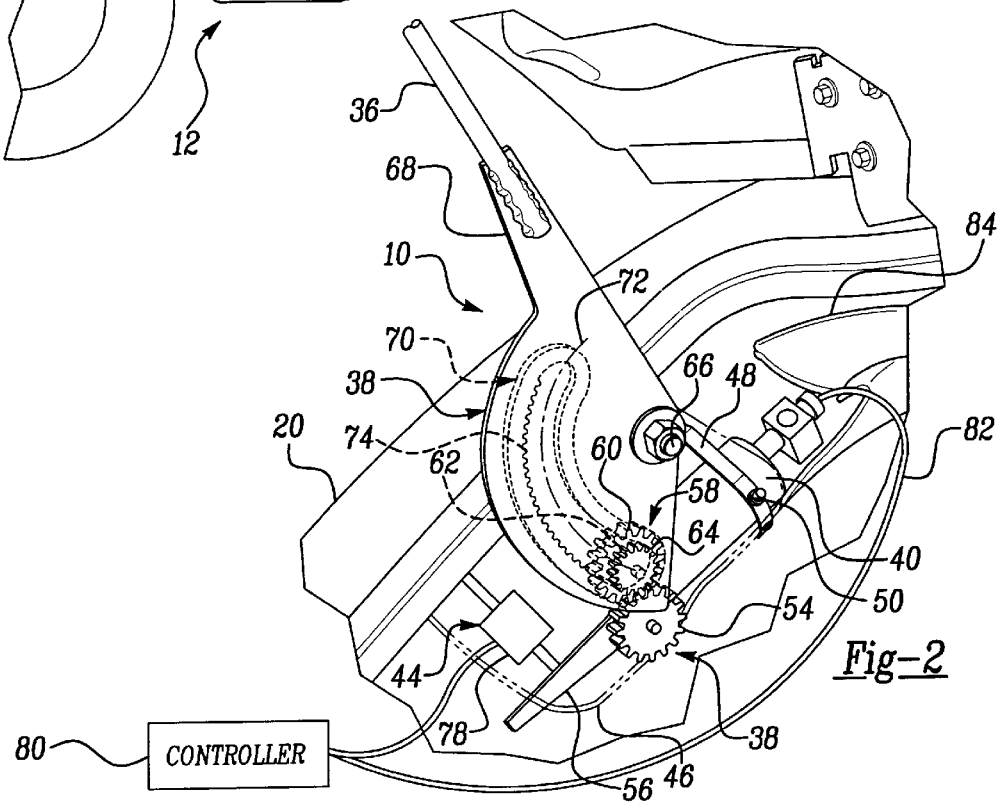
FIG. 2 is a partial perspective view of the power liftgate device having the trim panel removed for clarity.

Referring to FIG. 2, power liftgate device 10 includes a reversible electric motor 40 that drives a gearset 42. Gearset 42 in turn drives pneumatic actuator assembly 32. Power liftgate device further includes engaging means 44.

Reversible electric motor 40 is preferably disposed within D-pillar 20 of vehicle 12 such that the longitudinal axis of motor 40 is generally parallel to D-pillar 20. Motor 40 is mounted to a mounting bracket 46 (shown in phantom) by a pivot bracket 48 and a suitable fastener 50, such as a screw. Pivot bracket 48 enables motor 40 to pivot about fastener 50 in response to engaging means 44. Mounting bracket 46 is preferably formed of a heavy stock sheet metal, such as steel. Mounting bracket 46 is mounted to D-pillar 20 of vehicle 12 in a known manner, such as by welding, for providing means for supporting the components of power liftgate device 10.

Motor 40 is in driving engagement with a first driven gear 54 in a manner known in the art. For example, motor 40 may drive first driven gear 54 by attaching first driven gear 54 to an output shaft of motor 40. First driven gear 54 is rotatably mounted to and supported by an extension arm 56 extending from motor 40. First driven gear 54 rotates about an axis that is generally perpendicular to a longitudinal axis of motor 40. First driven gear 54 defines a plurality of gear teeth that engages with a corresponding plurality of gear teeth of a second driven gear 58. Second driven gear 58 is rotatably mounted to mounting bracket 46. More particularly, second driven gear 58 includes a primary section 60 engaging first driven gear 54 and a secondary section 62. Primary section 60 of second driven gear 58 is concealed behind mounting bracket 46. Secondary section 62 of second driven gear 58 extends through an aperture 64 formed in mounting bracket 46.

Each pneumatic actuator assembly 36 is pivotally attached to mounting bracket 46 such that pneumatic actuator assembly 32 pivots about an axis 66. More particularly, plate portion 38 is fixed to strut 36 using a suitable fastener (not shown) or fastening method for movement therewith. It should be noted that strut 36 and plate portion 38 might be integrally formed to define a single unit. Plate portion 38 is pivotally coupled to mounting bracket 46 via fastener 66.

Plate portion 38 is generally plate-like and includes an extension arm portion 68 and a gear-engaging portion 70 (shown hidden). Gear engaging portion 70 of plate portion 38 is adapted to engage secondary section 62 of second driven gear 58 to effect a driving relationship therewith. Specifically, gear engaging portion 70 is disposed on a reverse side of first drive arm 40 to prevent foreign objects from being caught between the gear teeth of second driven gear 58 and first drive arm 40. Gear engaging portion 70 generally defines an arcuate portion 72 having a gear tooth portion 74 extending along one side of arcuate portion 72. It should be appreciated that gear tooth portion 74 may be disposed along the inner edge or outer edge (as shown) of arcuate portion 72. Arcuate portion 72 is sized so as to properly engage second driven gear 58 without interfering with the rotational movement thereof.

Engaging means 44 is provided for selectively engaging first driven gear 54 with second driven gear 58. That is, engaging means 44 includes an actuating device 78 interconnecting extension 56 of motor 40 and D-pillar 20. Alternatively, it is anticipated that actuating device 78 may interconnect extension 56 of motor 40 and mounting bracket 46. Preferably, actuating device 78 of engaging means 44 is a solenoid operable to engage and disengage first driven gear 54 with second driven gear 58. Actuating device 78 is actuated by a controller 80 in response to a signal received from an operator. Controller 80 further controls electric reversible motor 40 via a line 82.

Preferably, power liftgate device 10 is substantially concealed in D-pillars 20 of vehicle 12 by a trim panel 84. Trim panel 84 generally extends between plate portion 38 of pneumatic actuator assembly 32 and mounting bracket 46 to provide improved aesthetic quality in vehicle 12. Thus, pneumatic actuator assembly 32 remains the only component visible to an operator.

During operation, an operator sends a signal to controller 80 to open liftgate 24 of vehicle 12. Latch mechanism 30 releases liftgate 24 to permit pivotal movement of liftgate 24 relative to cargo opening 16. Pneumatic actuator assemblies 32 drive liftgate 24 from latch mechanism 30, thereby initiating the opening of liftgate 24. Controller 80 further actuates actuating device 78 to engage first driven gear 54 with second driven gear 58. Motor 40 drives first driven gear 54 in a counter-clockwise direction (FIG. 2), thereby driving second driven gear 58 and plate portion 38 of pneumatic actuator assembly 32. Pneumatic actuator assembly 32 rotates clockwise such that strut 36 exerts an opening force on liftgate 24. Motor 40 continues to drive driven gears 54 and 58 to a predetermined opened position. To close liftgate 24, a signal is sent to controller 80 to close liftgate 24 of vehicle 12. Motor 40 drives first driven gear 54 in a clockwise direction (FIG. 2), thereby driving second driven gear 58 and pneumatic actuator assembly 32 in an opposite direction. Motor 40 continues to drive driven gears 54 and 58 to a predetermined closed position.

The power liftgate device of the present invention enables the pneumatic actuator or strut and lifting device to be simple and conveniently incorporated into a single integral unit, thereby reducing the number of parts required and the complexity of assembly.

The invention being thus described, it will be obvious that the same may be varied in many ways. Such variations are not to be regarded as a departure from the spirit and scope of the invention. Such variations or modifications, as would be obvious to one skilled in the art, are intended to be included within the scope of the following claims.

What is claimed is:

1. A power liftgate device for a liftgate of a vehicle, said device comprising:

a power drive unit;

a pneumatic actuator adapted to be pivotally coupled between the liftgate and the vehicle, said actuator exerting a force opposing retraction of the liftgate;

a driven gear being selectively driven by said power drive unit, said driven gear being fixed to said actuator to pivot therewith; and an engaging device adapted to be coupled to the vehicle for engaging said power drive unit with said driven gear, thereby enabling said power drive unit to drive said driven gear, said engaging device being positionable between an engaged and a disengaged position, wherein said engaging device is operable in said engaged position to engage said power drive unit into driving connection with said driven gear, said engaging device is operable in said disengaged position to disengage said power drive unit from said driven gear to enable said actuator to actuate freely.

2. The device according to claim 1 wherein said engaging device is a solenoid.

3. The device according to claim 1, further comprising:

a trim panel extending substantially around said power drive unit and said driven gear, thereby enclosing said power drive unit and said plurality of driven gears from a cargo area of the vehicle.

4. The device according to claim 1 wherein said driven gear is formed integrally with said actuator.

5. The device according to claim 1 wherein said power drive unit is operable to drive said driven gear in a first direction to open the liftgate of the vehicle and operable to drive said driven gear in a second direction to close the liftgate of the vehicle.

6. The device according to claim 1 wherein said power drive unit is an electrically-driven, reversible motor.

7. A power liftgate system for a vehicle, comprising:

a liftgate adapted to be pivotally attached to the vehicle, said liftgate being positionable in an opened or closed position;

a power drive unit;

a pneumatic actuator being pivotally mountable between said liftgate and the vehicle, said actuator biasing said liftgate in said opened position;

a driven gear being selectively driven by said power drive unit, said driven gear being fixed to said actuator to pivot therewith; and an engaging device adapted to be coupled to the vehicle for engaging said power drive unit with said driven gear, thereby enabling said power drive unit to drive said driven gear, said engaging device being positionable between an engaged and a disengaged position, wherein said engaging device is operable in said engaged position to engage said power drive unit into driving connection with said driven gear, said engaging device is operable in said disengaged position to disengage said power drive unit from said driven gear to enable said actuator to actuate freely.

8. The power liftgate system according to claim 7 wherein said engaging device is a solenoid.

9. The power liftgate system according to claim 7, further comprising:

a trim panel extending substantially around said power drive unit and said driven gear, thereby enclosing said power drive unit and said plurality of driven gears.

10. The power liftgate system according to claim 7 wherein said power drive unit is operable to drive said driven gear in a first direction to position said liftgate in said opened position and operable to drive said driven gear in a second direction to position said liftgate in said closed position.

11. The power liftgate system according to claim 7 wherein said power drive unit is an electrically-driven, reversible motor.

12. The power liftgate system according to claim 7 wherein said driven gear is formed intergrally with said actuator.

* * * * *